US005587556A

United States Patent [19]

Yamamoto et al.

[11] Patent Number: 5,587,556

[45] Date of Patent: Dec. 24, 1996

[54] PROTECTIVE CASING FOR END CONNECTING PART OF WIRE

[75] Inventors: Takatatsu Yamamoto; Shigehiko Kobayashi; Tomohiro Ikeda, all of Shizuoka-ken, Japan

[73] Assignee: Yazaki Corporation, Tokyo, Japan

[21] Appl. No.: 357,312

[22] Filed: Dec. 16, 1994

[30] Foreign Application Priority Data

Dec. 20, 1993 [JP] Japan ..... 5-320347

[51] Int. Cl.[6] ..... H01R 4/22

[52] U.S. Cl. ..... 174/74 R; 174/82; 174/87; 174/138 F; 174/92

[58] Field of Search ..... 174/87, 74 R, 174/88 R, 82, 92, 138 F

[56] References Cited

U.S. PATENT DOCUMENTS 4,435,612 3/1984 Smith ..... 174/92
4,795,857 1/1989 McInnis ..... 174/138 F
5,371,323 12/1994 Schneider et al. ..... 174/92
5,410,105 4/1995 Tahara et al. ..... 174/92

FOREIGN PATENT DOCUMENTS 4-24266 2/1992 Japan .
0641060 5/1994 Japan .

*Primary Examiner*—Laura Thomas
*Assistant Examiner*—Chau N. Nguyen
*Attorney, Agent, or Firm*—Wigman, Cohen, Leitner & Myers, P.C.

[57] ABSTRACT

A protective cover for accommodating an end connecting part of a bundle of wires includes a box-type of casing body provided with a storage chamber to accommodate the end connecting part therein and a lid pivotably connected to the casing body to close the opened upper portion thereof. A bottom wall of the casing body is provided with a stop in the shape of a rectangular plate. With the arrangement, when accommodating the ends of the wires in the casing, the stop intrudes into the wires. Under this condition, even if the wires are pulled outside the casing, the end connecting part of the wires is hooked by the stop, whereby the wires can be retained in the casing without being drawn therefrom.

15 Claims, 11 Drawing Sheets

PROTECTIVE CASING FOR END CONNECTING PART OF WIRE

BACKGROUND OF THE INVENTION

The present invention relates to a protective casing for accommodating an end connecting part of a bundle of wires.

In case that a plurality of wires has been connected to each other by joining a bundle of conductive ends of the wires, thereafter, the end connecting part of the wires generally accommodated in a protective casing made of insulating material. In a prior art, there are known a L-shaped protective casing of fixture-type, which is disclosed in Japanese Utility Model Publication No. 4-24266 and a protective casing of strain-relief type.

The former casing consists of a box-type casing body provided with an opened upper part and an opened side part thereof, which has a L-shaped wire end storage part therein, and a lid pivotably connected with a margin of the casing body for closing the opened upper part thereof. The lid is provided on lateral sides thereof with locking parts which are to be engaged with engagement parts formed on the casing body when it is closed by the lid.

When the end connecting part of the wires is accommodated in the above mentioned casing, the end connecting part of some rigidity are bent so as to accord with the profile of the wire end storage part. Under such a accommodating condition, due to resistance from the bent end connecting part, the protective casing can be maintained to be integral with the ends of the wires in spite of tensile strength applied thereon.

In the former protective casing, however, since the end connecting part are accommodated in the casing by bending the end connecting part of some rigidity forcibly, such an accommodating operation is apt to be so difficult for an operator and furthermore, joined surfaces of the ends are easy to be apart from each other because of increased burden on the joined surfaces.

In the latter casing of strain-relief type, under condition that each wire is arranged in a row transversely and flatly, ends of the conductive parts of the wires are bundled and joined to each other. As well as the former casing, the casing consists of a casing body and a lid for closing the body. The lid is also provided on both lateral sides thereof with locking parts for locking on the lid in a condition that it closes the upper side of the casing body. Inside the casing body, a wire end storage part is provided having a recess on a bottom wall thereof. On the other hand, the lid is provided on an internal surface thereof facing the bottom wall with a projection which is inserted into the recess in case of closing the lid.

When the end connecting part of the wires are accommodated in the protective casing and then it is closed by the lid, the wires are forcibly curved or wound since the projection is engaged into the recess. Consequently, due to resistance of this curved or wound portion of the wires, the protective casing can be maintained to be integral with the ends of the wires in opposition to tensile strength applied thereon.

In the latter protective casing, however, since it has to contain the wires arranged in the row transversely, there is a drawback of increasing the width of the casing. In addition, in case of accommodating the wires of different sizes, a clearance between the projection and the recess has to be changed corresponding to the sizes of the wires. Therefore, in practical, there is raised a problem that a variety of casings must be prepared for every sizes of the wires.

SUMMARY OF THE INVENTION

It is therefore an object of the present invention to provide a protective casing which can offer an easy accommodating operation and lighten the burden applied on the joined portion of the wires.

Another object of the present invention is to provide a protective casing for end connecting part of the wires, which permits miniaturization of the casing itself and which can accommodate the wires of different sizes therein.

The objects of the invention described above can be accomplished by a protective casing for accommodating an end connecting part of a bundle of wires, comprising:

a casing body provided with a storage chamber to accommodate the end connecting part therein, said casing body having an opened upper portion and opened side portion on at least one side thereof in the longitudinal direction; and a lid pivotably connected to said casing body to close said upper portion and said opened side portion;

wherein said casing body is provided on a bottom wall thereof with a stop which projects therefrom thereby to be inserted between the wires under condition that the wires are accommodated in the protective casing.

With the arrangement, in case of accommodating the ends of the wires in the casing, the stop intrudes into the wires. Under such a condition, even if the wires are pulled outside the casing, the end connecting part of the wires is hooked by the stop since the respective wires are joined to each other at the end connecting part. Therefore, the wires can be retained in the casing without being drawn therefrom.

In the present invention, preferably, the lid is provided on an inner surface thereof with a presser piece. In this case, on a way of the lid for closing the casing body, the presser piece presses against the wires. Therefore, under condition that the casing body is closed by the lid, the presser piece serves to prevent the end connecting part from shaking in the casing body. Further, it also serves to prevent the wires once accommodated from rushing out of the casing.

Further preferably, in the present invention, the lid is provided on an inner surface with a projection which is arranged in a position corresponding to the stop of the casing body. In closing the case by the lid, the projection forces the wires riding on the stop into both sides thereof, whereby the wires can be hooked by the stop securely.

In the present invention, preferably, the stop is shaped to be a triangular plate and the projection is formed to be a triangular cone. In this case, due to its sharpness of the projection, the wires riding on the stop can be easily divided into both sides thereof.

Preferably, the projection is so arranged on the inner surface of the lid as not to interfere with the stop under condition that the casing body is closed by the lid. With such an arrangement, the durability of the projection and the stop can be improved.

Furthermore, according to the present invention, there is also provided a protective casing for accommodating an end connecting part of a bundle of wires, comprising:

a casing body provided with a storage chamber to accommodate the end connecting part therein, the casing body having an opened upper portion and opened side portions on both sides thereof in the longitudinal direction; and a lid pivotably connected to the casing body to close the upper portion and one of the opened side portions;

wherein the casing body is provided on a bottom wall thereof with a stop which projects therefrom thereby to be inserted between the wires under condition that the wires are accommodated in the protective casing.

With the arrangement, in case of accommodating the end connecting part of the wires in this protective casing, the wires is attached to the casing in such a manner that the stop intrudes into the wires while the end connecting part protrudes from the opened sides of the casing body. Consequently, it becomes to be easy to expand the wires to each other and to insert the stop between the wires. Thereafter, by drawing the wire, the end connecting part of the wires is brought to the casing body and then, the upside thereof is closed by the lid. Under such a condition, even if the wires are further pulled outside the casing, the end connecting part of the wires is hooked by the stop, whereby it is possible to prevent the end connecting part of the wires from falling out of the casing.

In the invention, it is preferable that the stop is shaped to be a triangular plate. Also in this case, due to its sharpness of the stop, the wires riding thereon can be easily divided into both sides thereof when closing the casing body by the lid.

Other objects and features of the present invention will become more fully apparent from the following description and appended claims taken in conjunction with the accompanying drawings.

DESCRIPTION OF THE PREFERRED EMBODIMENTS

Embodiments of the present invention are now described with reference to the drawings.

The First Embodiment

Figure 1A:
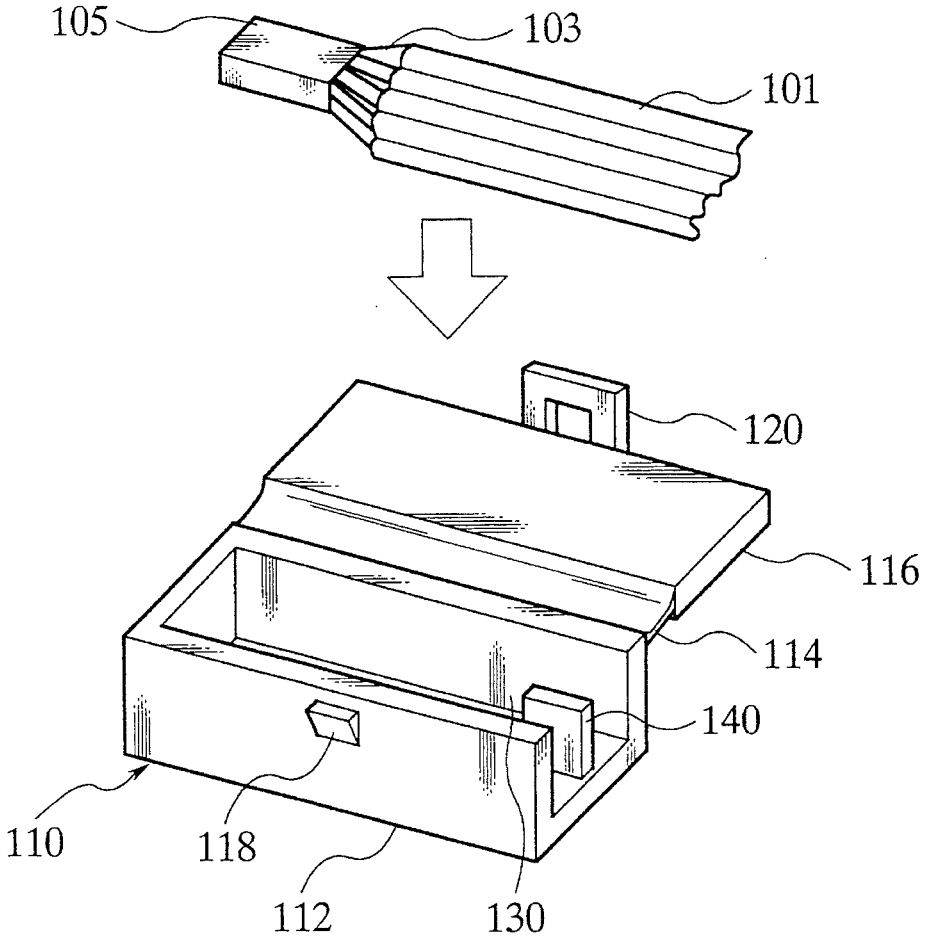
FIG. 1A is a perspective view showing a protective casing in accordance with a first embodiment of the present invention, which is in a condition before accommodating an end connecting part of bundled wires therein.
Figure 1B:
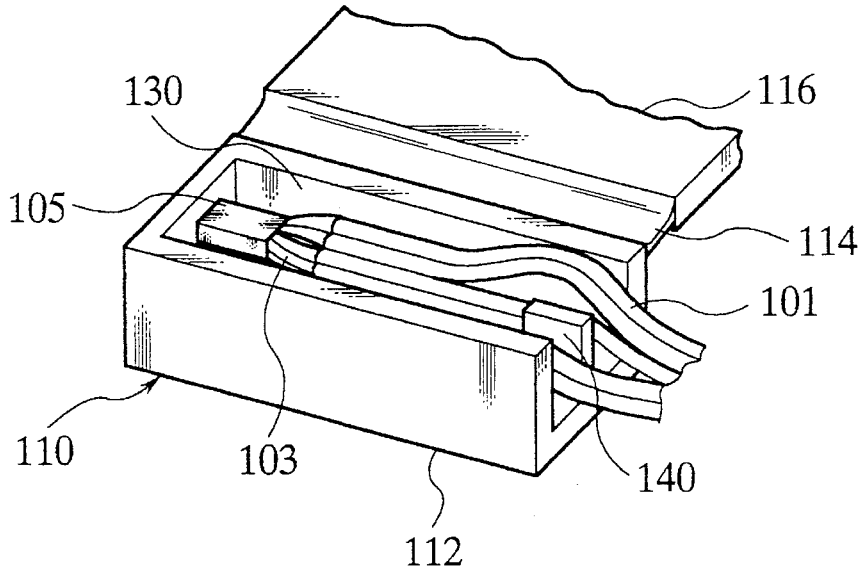
FIG. 1B is a perspective view showing the protective casing of FIG. 1A, which is in a condition after accommodating the end connecting part but closing a lid.

FIGS. 1A and 1B show the first embodiment of the invention, in which FIG. 1A shows a protective casing under condition before an end connecting part of wires is accommodated therein and FIG. 1B shows a condition that the casing has not be closed but the end connecting part is accommodated therein.

In these figures, reference numeral 101 designates wires, 103 respective conductive parts of the wires 101 and 105 an end connecting part for the wires 101. A plurality of wires 101 having the conductive parts 103 bundled are connected to each other and joined integral with the end connecting part 105 of a rectangular cross section.

A protective casing 110 consists of a casing body 112 shaped to be a rectangular box and a lid 116 pivotably connected to the casing body 112 through the intermediary of a hinge 114. The casing body 112 comprise a bottom wall and three sidewalls. An upper portion and one side portion of the casing body 112 are opened. The lid 116 has a locking member 120 formed on a side thereof. When the opened upper portion of the casing body 112 is closed by the lid 116, the locking member 120 is engaged with a locking projection 118 which is formed on the sidewall of the casing body 112. Inside the casing body 112, a storage chamber 130 is formed to accommodate the end connecting part 105 of the wires 101. In the storage chamber 130, a stop 140 of a rectangular plate is arranged in the vicinity of the opened side portion to project from the bottom wall of the casing body 112. The height of the stop 140 is established so as to be substantially equal to that of the sidewall of the casing body 112.

Figure 2:
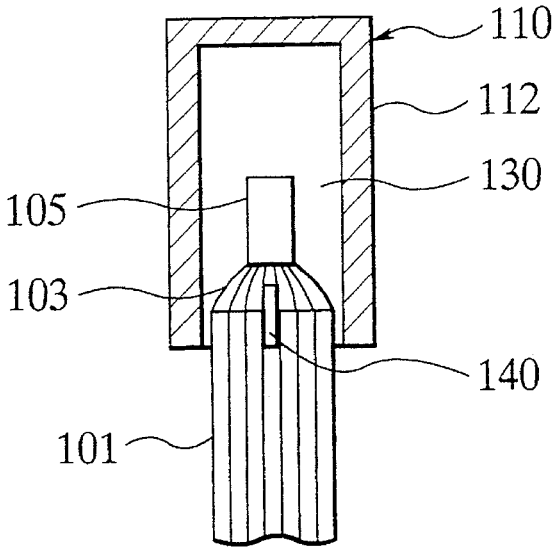
FIG. 2 is a plan view showing a condition under which the end connecting part are accommodated in the protective casing in accordance with the first embodiment of the present invention.

The above protective casing 110 operates as follows. When the ends of the wires 101 are accommodated in the casing 110, the stop 140 intrudes into the bundle of wires 101 thereby to divide them into two smaller bundles of wires 101, as shown in FIG. 2. Therefore, with such an arrangement, even if the wires 101 are pulled outside the casing 110, the end connecting part 105 is hooked by the stop 140, so that the wires 101 can be still retained in the casing 110 without being withdrawn therefrom.

Figure 3:
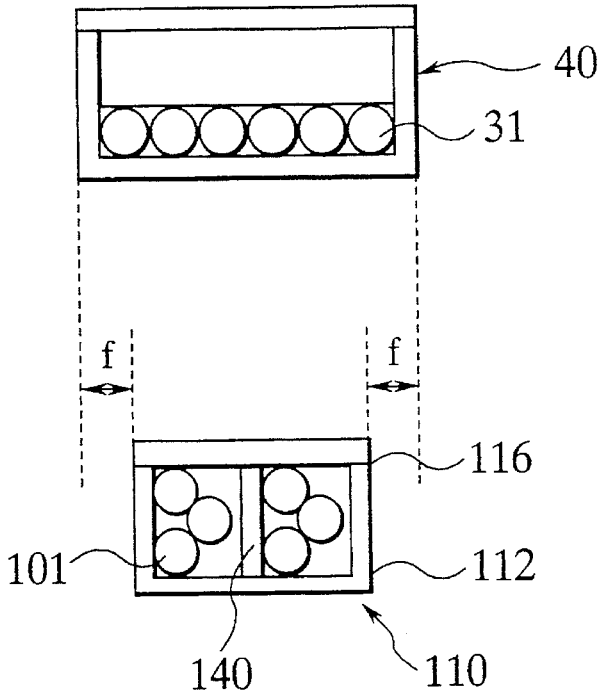
FIG. 3 (PRIOR ART)
FIG. 3 is an explanatory diagram showing a difference between the protective casing of the first embodiment and the conventional casing.

According to the embodiment, there is no need to arrange the wires in a row in the casing 110. Therefore, as shown in FIG. 3, it is possible to reduce the width of the casing by a dimension of 2f in comparison with the conventional casing 40, so that the casing 110 can be miniaturized.

Figure 4A:
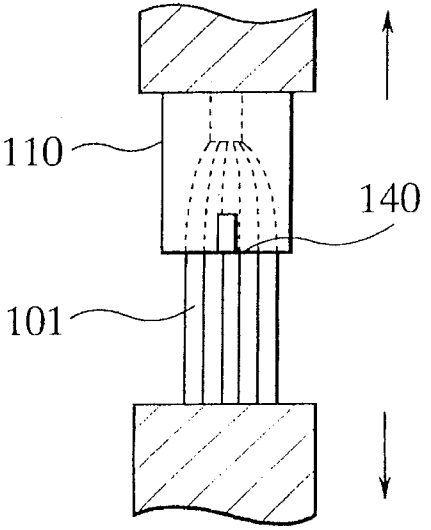
FIG. 4A is a diagram for explaining how to execute a tensile strength test for the protective casing in accordance with the first embodiment of the invention.
Figure 4B:
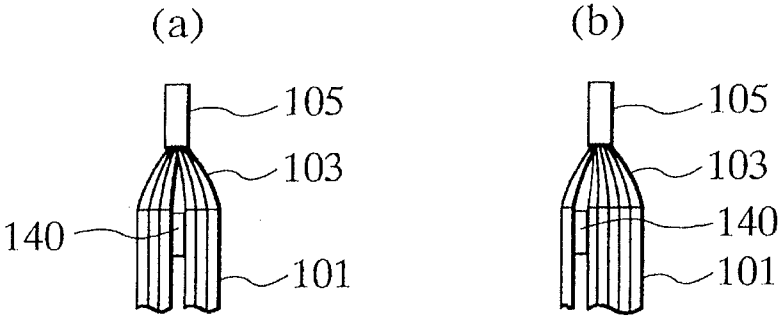
FIG. 4B shows samples for the tensile strength test of FIG. 4A.
Figure 4C:
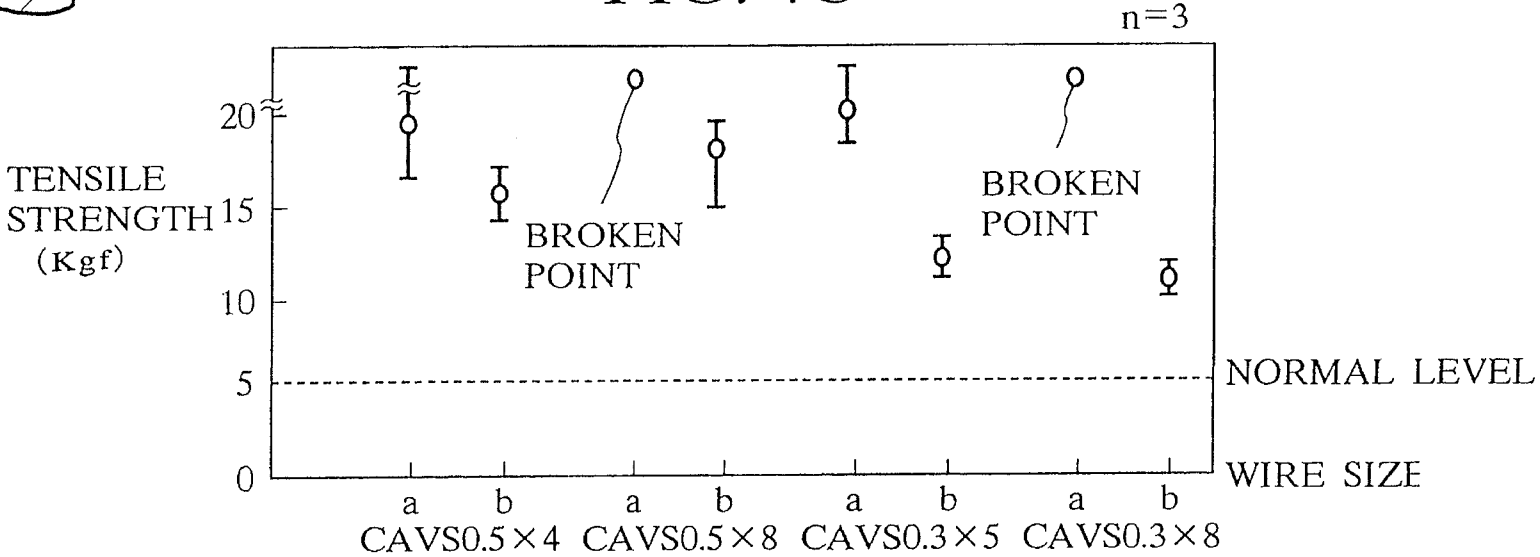
FIG. 4C is a diagram showing a result of the tensile strength test.

Further, according to a tensile strength test of the casing 110 having the ends of the wires accommodated therein, it has been found that the casing of the present embodiment can possess a high tensile strength in excess of a strength required for a normal casing. FIGS. 4A, 4B and 4C are diagrams for explanation of this situation and result in the above tensile strength test.

In the test, the tensile strength at the breaking point was measured by pulling the protective casing 110 and the wires 101 in opposite directions, respectively, as shown in FIG. 4A. As specimens for test, a specimen shown in (a) of FIG. 4B where the stop 140 divides the wires 101 into two bundles of wires evenly and another specimen shown in (b) of FIG. 4B where the stop 140 divides the wires 101 into one wire and the remaining wires, were prepared. The result of test was that either of the specimens (a) and (b) exhibited improved tensile strength in excess of the required strength, as shown in FIG. 4C. Consequently, it has been found that the use of the protective casing 110 of the embodiment can assure the tensile strength is more than that of the conventional casing.

The Second Embodiment

Figure 5A:
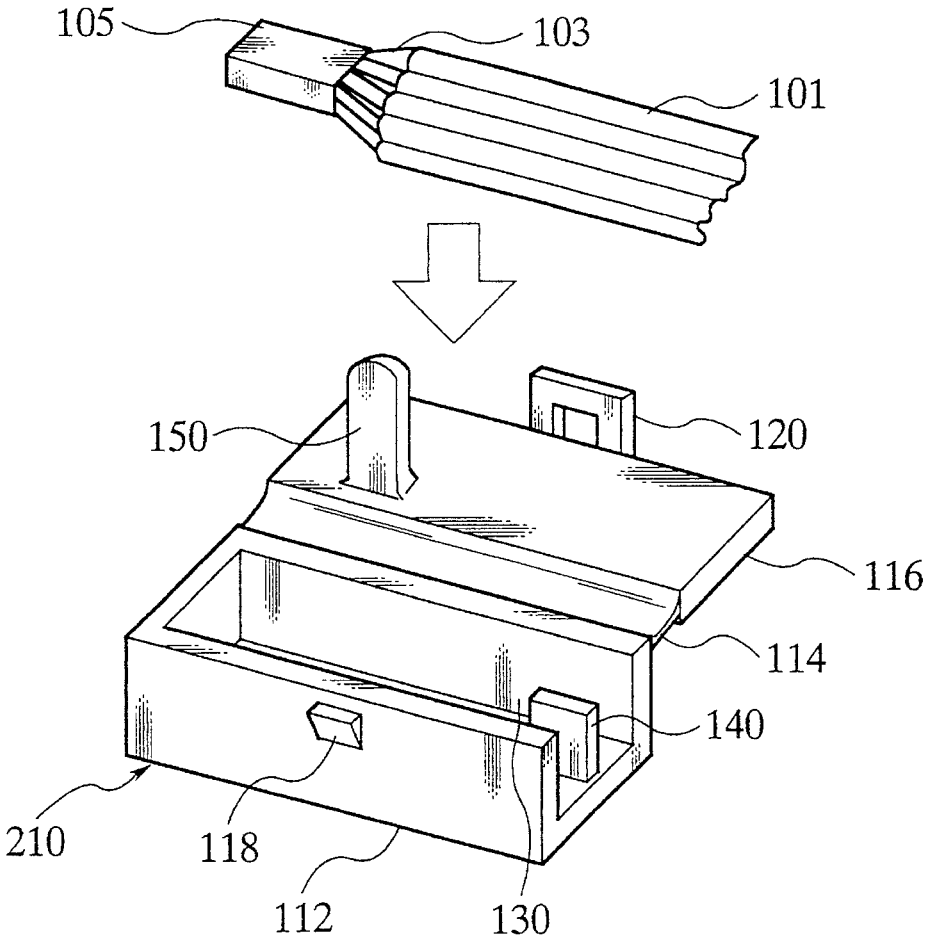
FIG. 5A is a perspective view showing a protective casing in accordance with a second embodiment of the present invention, which is in a condition before accommodating an end connecting part of respective wires therein.
Figure 5B:
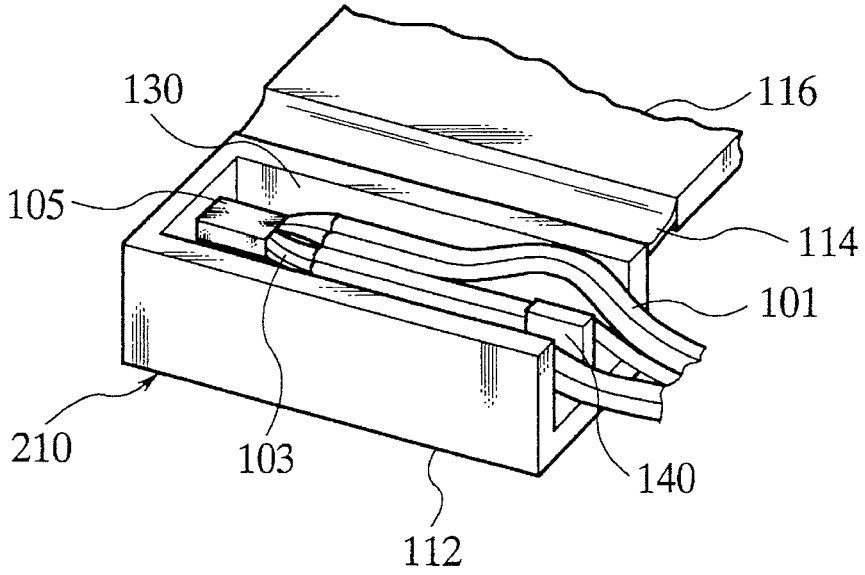
FIG. 5B is a perspective view showing the protective casing of FIG. 5A, which is in a condition after accommodating the end connecting part but closing a lid.

FIGS. 5A and 5B show a second embodiment of the invention, in which FIG. 5A shows a protective casing before the ends of wires are accommodated therein and FIG. 5B shows a condition wherein the casing has not yet been closed by the lid when the wires are accommodated in the casing.

The protective casing 210 of the second embodiment is provided on an inner surface of the lid 116 thereof with a presser piece 150 for pressing against the wires 101. The presser piece 150, projects perpendicular to the inner surface of the lid 116 and is arranged so as to abut on the end connecting part 105 accommodated in the casing 210. The length of the presser piece 150 is established to be somewhat less than the inside width of the casing body 112 and the piece 150 itself is formed to have flexibility at a base end thereof.

Figure 6:
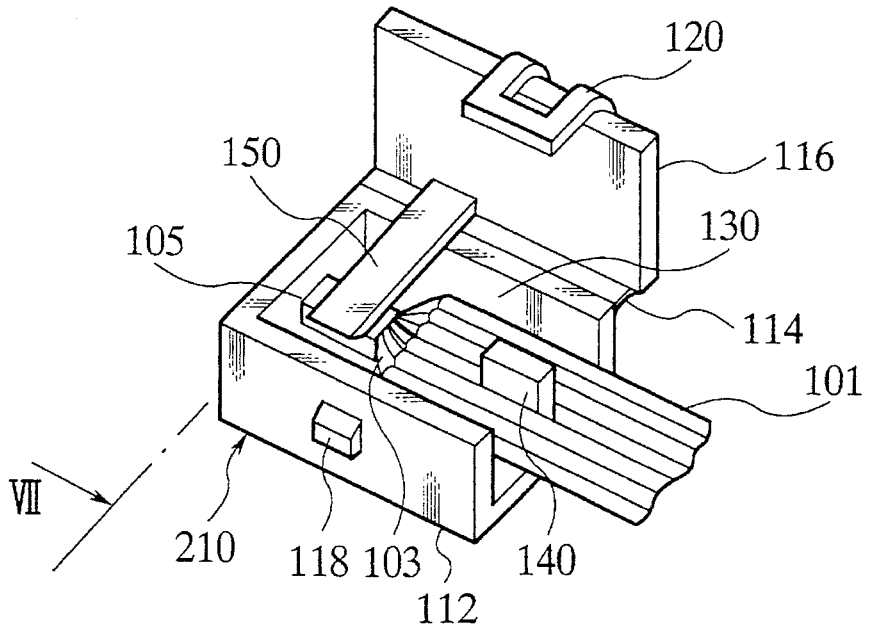
FIG. 6 is a perspective view showing the protective casing of the second embodiment, in process of closing the lid after accommodating the end connecting part.
Figure 7:
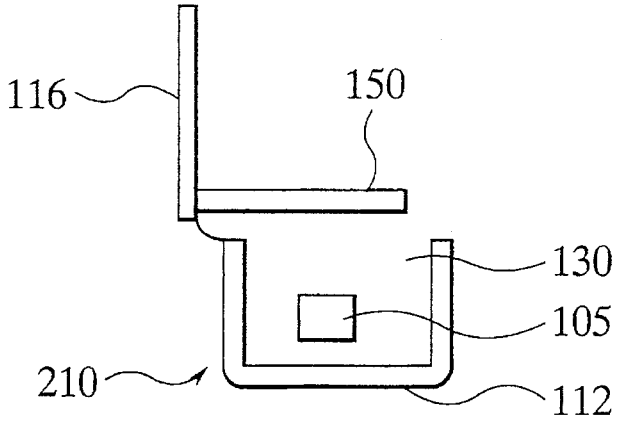
FIG. 7 is a cross sectional view taken along a line of VII of FIG. 6.
Figure 8:
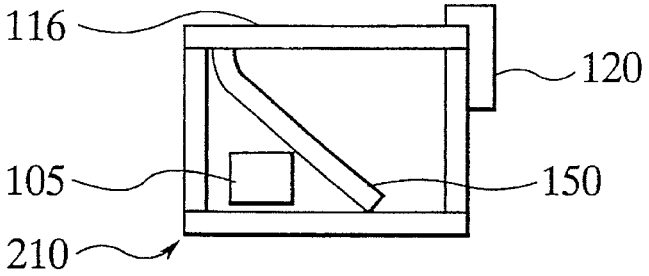
FIG. 8 is a cross sectional view similarly to FIG. 7, which shows a condition under which the lid is perfectly closed after accommodating the end connecting part in the protective casing of the second embodiment.

The protective casing 210 operates as follows. When the casing body 112 is closed by the lid 116 the bundle of wires 101 is accommodated in the casing body 112, the presser piece 150 then closes against an upside of the end connecting part 105 as shown in FIGS. 6 and 7 and serves to press the wires 101 downwardly so as not to protrude from the casing body 112. That is, according to the second embodiment, it is possible to close the lid 116, pressing down the wires 101 stably, whereby the closing operation can be simplified. Further, when the casing body 112 is fully closed by the lid 116, it is possible to prevent the end connecting part 105 from shaking in the casing body 112 since the presser piece 150 presses down the end connecting part 105 elastically, as shown in FIG. 8.

The Third Embodiment

Figure 9:
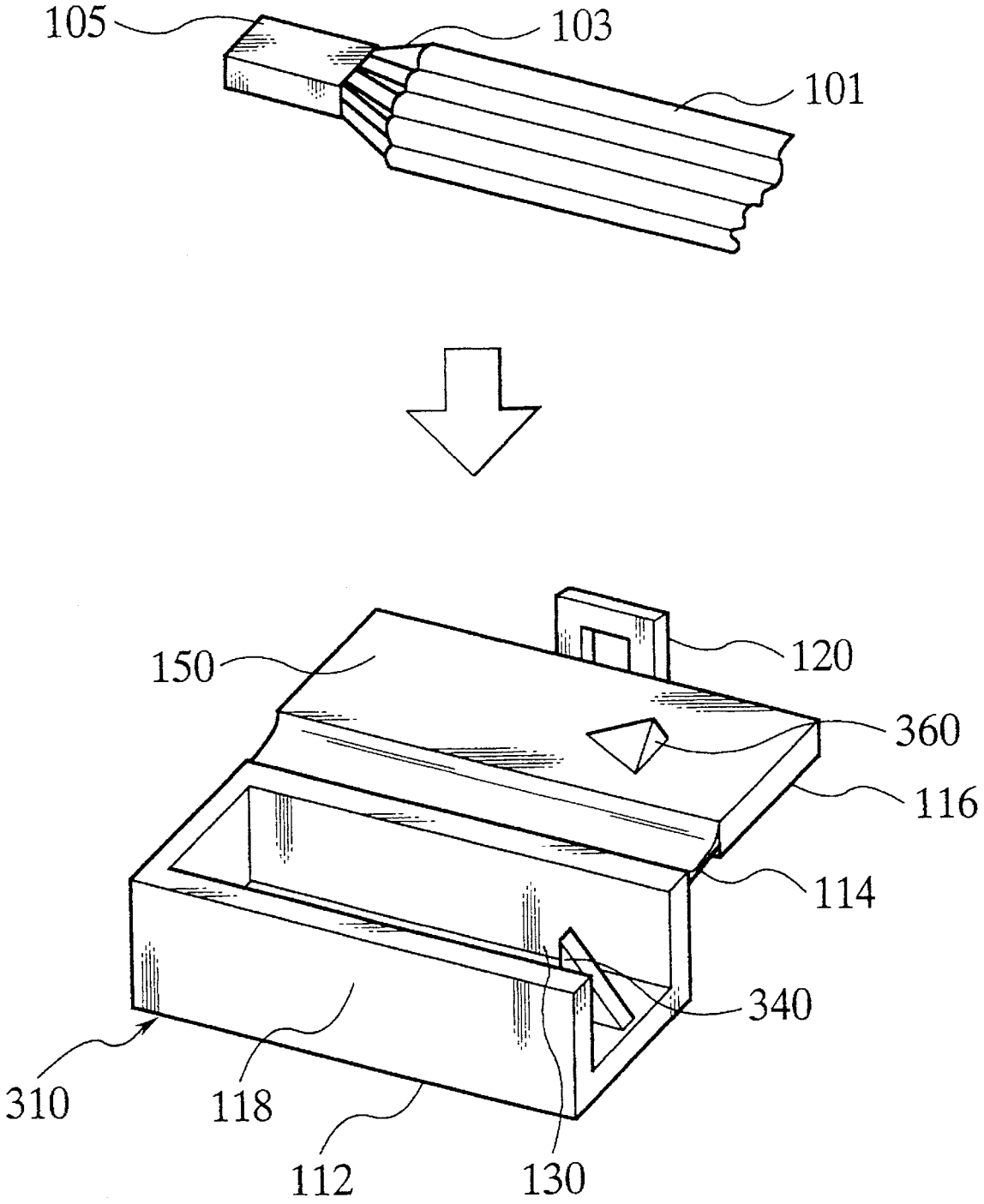
FIG. 9 is a perspective view showing a protective casing in accordance with a third embodiment of the present invention, which is in a condition before accommodating an end connecting part of respective wires therein.
Figure 10:
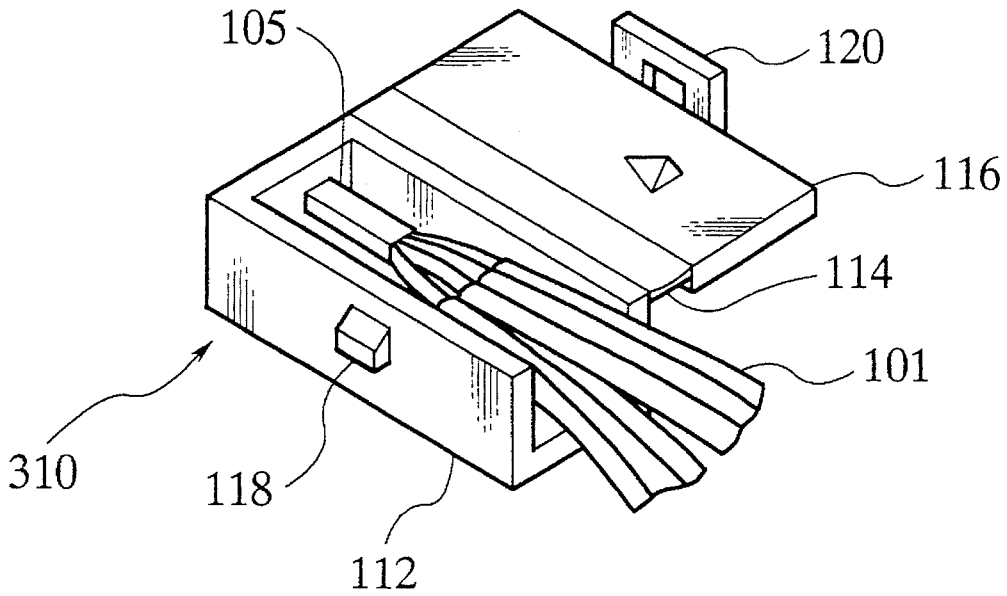
FIG. 10 is a perspective view showing the protective casing of FIG. 9, which is in a condition after accommodating the end connecting part but closing a lid.
Figure 11:
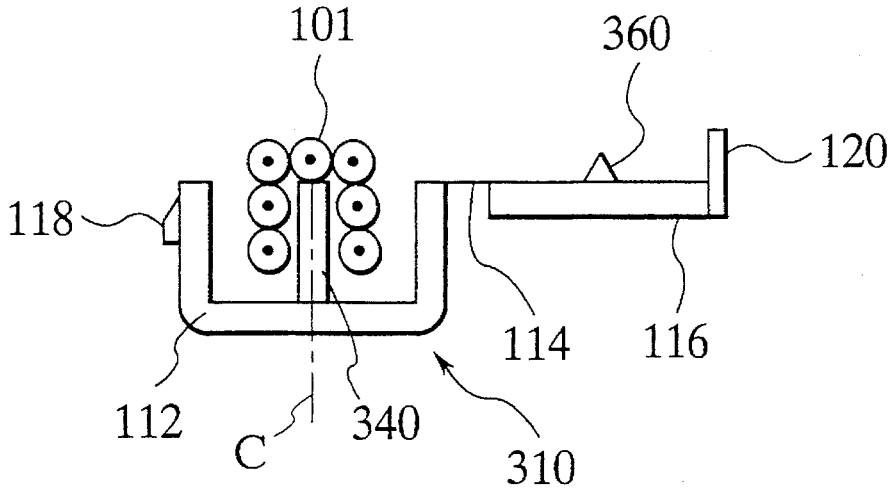
FIG. 11 is a side view of FIG. 10, in an extending direction of the wires accommodated in the casing.

FIGS. 9, 10 and 11 show a third embodiment of the invention, in which FIG. 9 shows a protective casing before the ends of wires are accommodated therein and FIGS. 10 and 11 show the condition before closing the lid while the wires are accommodated in the casing.

The protective casing 310, has a right-angled triangular stop 340 corresponding to the rectangular plate-shaped stop 140 of the first embodiment. It is provided on an inner surface of the lid 116 with a projection 360 for forcing the wires 101 riding on the stop 340 to both sides thereof.

Figure 13:
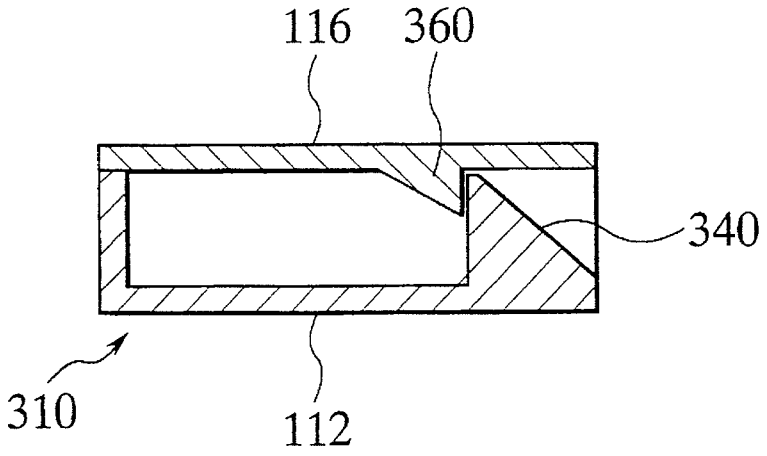
FIG. 13 is a lateral cross sectional view showing a relationship in position between a projection and a stop of the protective casing of the third embodiment when the casing is closed.

The stop 340 includes an outside oblique surface and an inside surface perpendicular to the bottom surface, both of which define an acute-angled apex. On the other hand, the projection 360 is formed into a triangular cone defined by one side surface perpendicular to the inner surface of the lid 116 as shown in FIG. 13. The other two surfaces face obliquely to both directions extending perpendicular to the opposite sidewalls of the stop 340, when the casing body 112 is closed. The projection 360 is formed so that the apex thereof is situated on a center line C (FIG. 11) of the stop 340 when the casing body 112 is fully closed by the lid 116. Further, the projection 360 is so arranged on the inner surface of the lid 116 that it does not interfere with the stop 340 when the casing body 112 is closed. From this point of view, the relative positional relationship between the stop 340 and the projection 360 is established such that the inside surface of the stop 340 faces to the vertical side surface of the projection 360, as shown in FIG. 13. With such an arrangement, the durability of the projection 360 and the stop 340 can be improved.

Figure 12:
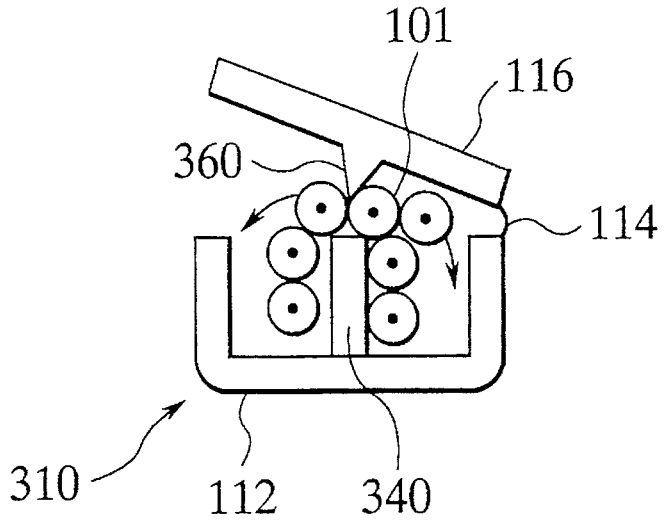
FIG. 12 is a side view showing the protective casing of the third embodiment, in process of closing the lid after accommodating the end connecting part.

The protective casing 310 constructed this way operates as follows. When the casing body 112 is closed by the lid 116 after accommodating the wires 101 in the casing body 112, the projection 360 pushes aside any wires 101 which may ride on the stop 340 separately, the wires 101, as shown in FIG. 12. Therefore, according to the third embodiment, when closing the casing body 112 by the lid 116, the wires 101 are easily divided into two groups so that the accommodating operation can be simplified. Note that the triangular configuration of the stop 340 promotes such a dividing action of the casing 310 on the wires 101.

Figure 14:
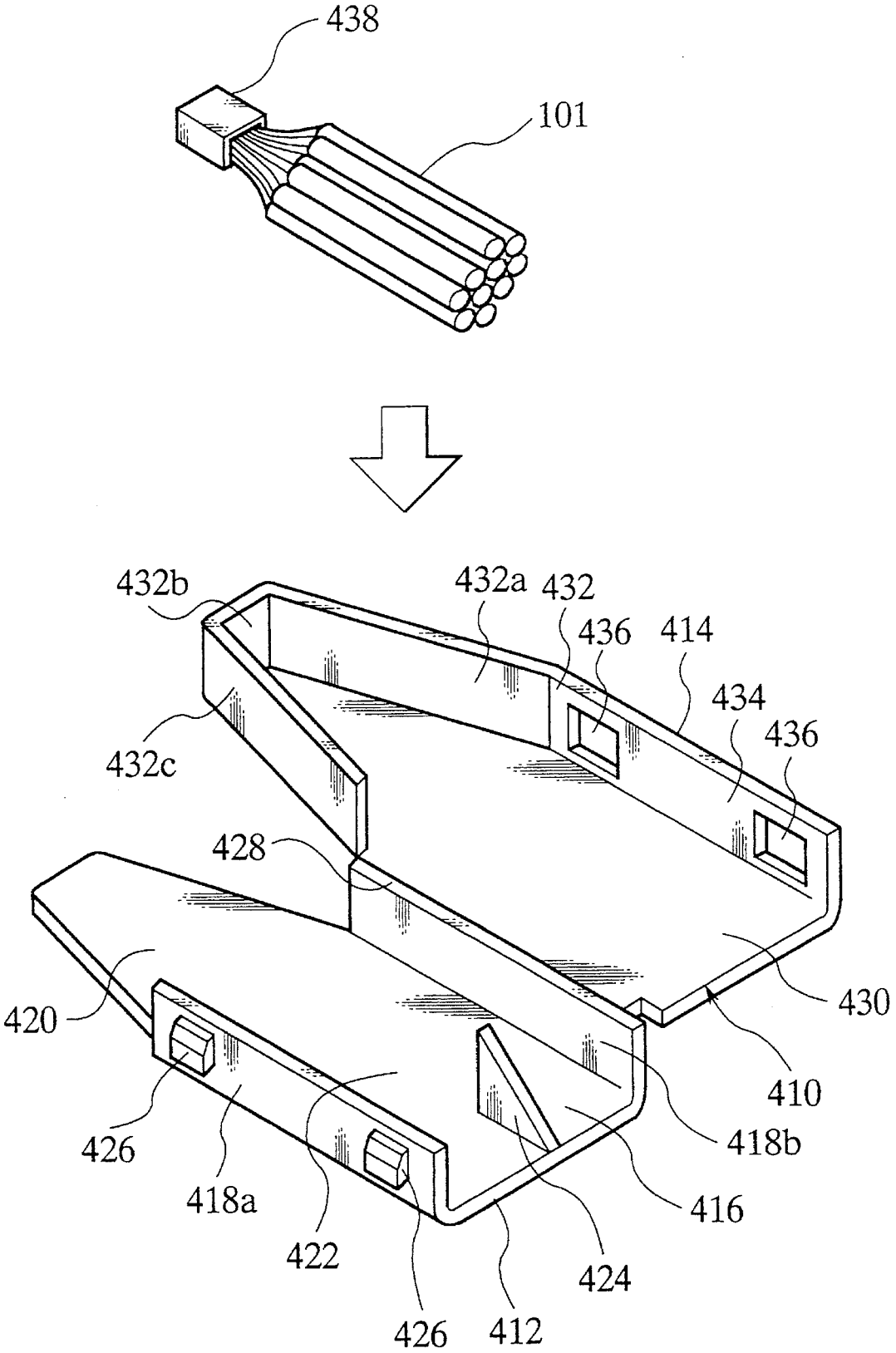
FIG. 14 is a perspective view showing a protective casing in accordance with a fourth embodiment of the present invention.

The Fourth Embodiment FIGS. 14, 15, 16A and 16B show a fourth embodiment of the invention. As shown in FIG. 14, a protective casing 410 of the embodiment consists of a casing body 412 and a lid 414 pivotably connected to the body 412 for closing it. The casing body 412 consists of a bottom wall 416 and sidewalls 418*a* and 418*b* arranged on both sides thereof. Therefore, both side portions of the casing body 412 extending in the direction of the wires 101 are opened together and an upper portion thereof is also opened. The bottom wall 416 is provided on one side thereof with a substantially triangular storage chamber 420 the width of which is gradually decreased as it approaches the distant end of the bottom wall 416. Adjacent to the chamber 420, a wire storage chamber 422 for accommodating the wires 101 is defined on the other side of the bottom wall 416. Both of side portions of the end connecting chamber 420 and an upper portion thereof are opened together. On the other hand, the wire storage chamber 422 is provided on both sides thereof with the sidewalls 418*a* and 418*b*. At the intermediate position between the sidewalls 418*a* and 418*b* at the rear end of the chamber 422 and opposite the storage chamber 420, a triangular stop 424 is formed having a height equal to that of each sidewall 418*a* (418*b*) and having a downwardly slanted surface facing to the opening.

The sidewall 418*a* has on an external surface thereof two engagement projections 426 which are adapted to be inserted and engaged into two engagement holes 436 formed in the lid 414. The lid 414 is pivotably connected with an upper end of the other sidewall 418*b* through the hinge 428. It comprises a bottom wall 430 the shape of which is substantially identical to that of the bottom wall 416 of the casing body 412. The lid further comprises a sidewall 432 formed around the bottom wall 430 except for a peripheral part thereof connected to the hinge 428. The sidewall 432 is constituted by three wall parts 432*a*, 432*b* and 432*c*, which correspond to the profile of the storage chamber 420, and a sidewall part 434 connected to the wall part 432*a*. When the upside of the casing body 412 is closed, the wall parts 432*a* and 432*c* close both sides of the storage chamber 420 in the width direction. Similarly the wall part 432*b* closes an opening part of the chamber 420 in the longitudinal direction thereof. The rectangular engagement holes 436 are formed in the sidewall 434 to engage with the engagement projections 426, respectively.

Figure 16A:
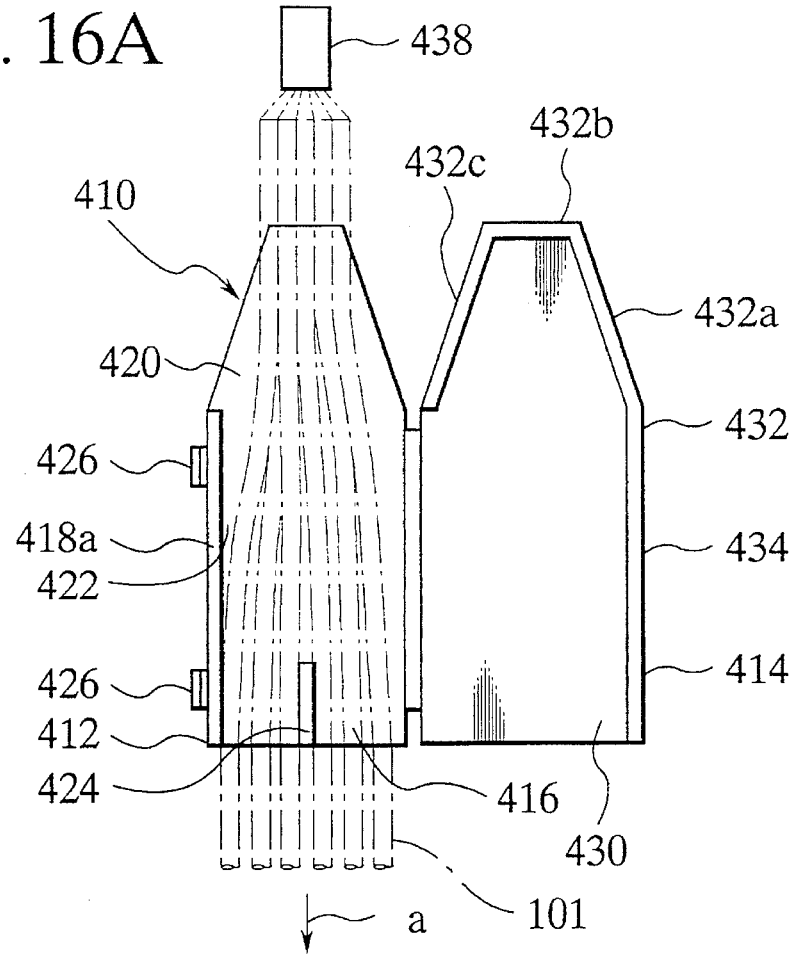
FIG. 16A is a plan view showing the protective casing in accordance with the fifth embodiment of the present invention, which is in a condition before accommodating the end connecting part of the wires therein.

In order to accommodate the end connecting part 438 of the wires 101 in the protective casing 410 constructed in this way, as shown in FIG. 16A, the bundle of wires 101 is attached to the casing 410 such that the stop 424 is inserted between the plural wires 101 while the end connecting part 438 protrudes from the bottom wall 416 of the casing body 412. Note that the reason for such an arrangement is that if the stop 424 was inserted between the wires 101 in the vicinity of the end connecting part 424, it would be hard to insert the stop 424 between the wires 101 because of increased difficulty in expanding them relative to each other. On the contrary, in a position apart from the end connecting part 438, it is easy to expand the wires 101 to relative each other and to insert the stop 424 therebetween.

Figure 16B:
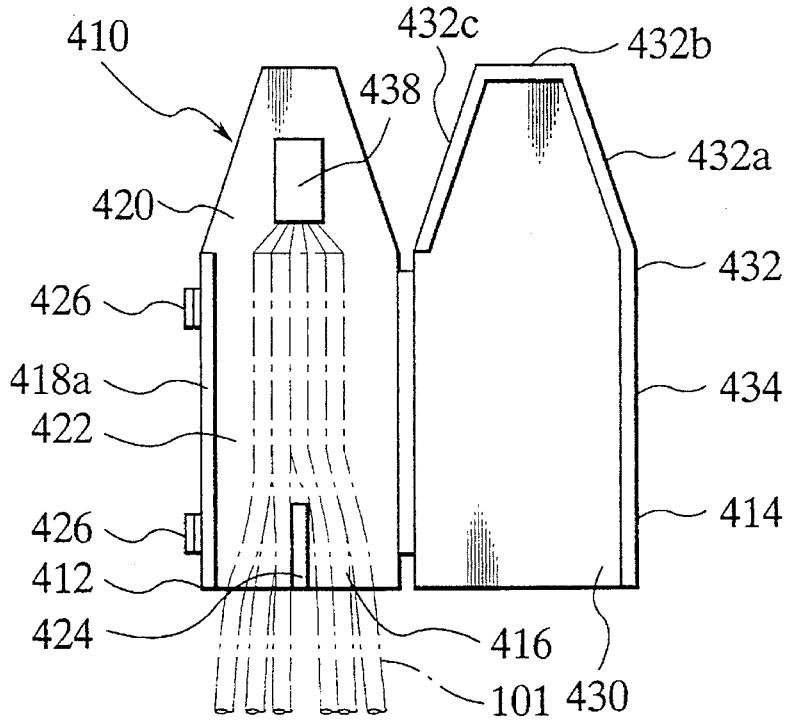
FIG. 16B is a plan showing the protective casing of FIG. 16A, in which the end connecting part of the wire is accommodated therein.

After inserting the stop 424 between the wires 101, the wires 101 are drawn in direction a of FIG. 16A so that the end connecting part 438 approaches the stop 424 to lie in the storage chamber 420, as shown in FIG. 16B. Note, during the movement of the wires 101, the triangular core configuration of the stop 424 facilitates the relative movement thereof between the wires 101 smoothly.

Figure 15:
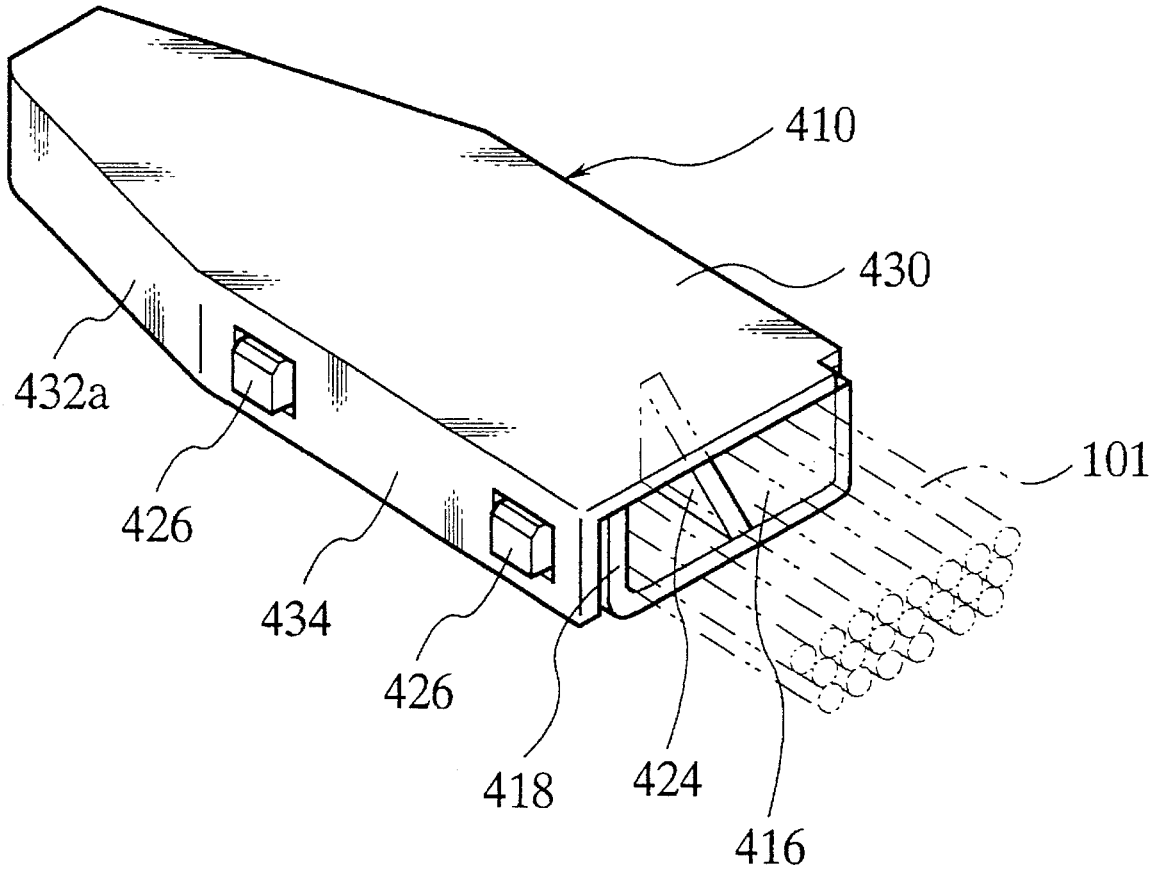
FIG. 15 is a perspective view showing a protective casing in accordance with a fifth embodiment of the present invention, in which an end connecting part of respective wires is accommodated therein.

After the end connecting part 438 has reached the storage chamber 420, the lid 414 is rotated to close the upside of the casing body 412 as shown in FIG. 15. In this state, the engagement projections 426 of the sidewall 418 are engaged in the engagement holes 436 of the sidewall 434, respectively, so that both sidewalls 418 and 434 are overlapped to each other. Further, the other opened portions about the storage chamber 420 are closed by the wall parts 432*a*, 432*b* and 432*c*. In this way, the end connecting part 438 can be accommodated in the protective casing 410 of the embodiment.

According to the embodiment, since the stop 424 is inserted between the wires 101 at the wire-part apart from the end connecting part 438, it is possible to expand the wires 101 with each other and to insert the stop 424 therebetween easily. Consequently, the operation to accommodate the end connecting part can be simplified. Similarly to the first embodiment, since there is no need to accommodate the end connecting part by bending it forcibly, the burden on the joined surfaces of the wire ends can be reduced.

In addition, since the wires 101 is accommodated in the casing body 412 by sliding the end connecting part 438 in the longitudinal direction of the casing body 412, the whole length thereof can be shortened for its miniaturization. Also, any wires of different sizes can be accommodated in the casing body 412.

Note that, when the end connecting part 438 is accommodated in the casing body 410, the forces exerted thereon are mainly the tension to the stop 424 and the expansion onto the openings defined by casing body 412 and the lid 414, so that any force is not applied on either of the wall parts 432*a* and 432*c*. Therefore, in the modification, these wall parts 432*a* and 432*c* may be provided on the casing body 412.

Finally, it will be understood by those skilled in the art that the forgoing description of the preferred embodiments of the disclosed structure, and that various changes and modifications may be made to the present invention without departing from the spirit and scope thereof.

We claim:

1. A protective casing for accommodating an end connecting part of a bundle of wires, comprising:

a casing body forming a storage chamber therein to accommodate the end connecting part, said casing body having an opened upper portion and an opened side portion on at least one side thereof in the longitudinal direction; and a lid pivotably connected to said casing body to close said upper portion, said lid having a presser piece formed on an inner surface of said lid to press against the end connecting part when said lid is closed against said casing body;

wherein said casing body has a stop member which projects inwardly from a bottom wall of said casing body and which separates the wires when the wires are accommodated in the protective casing.

2. A protective casing, as claimed in claim 1, wherein said inner surface of said lid is provided with a projection disposed in a position directly corresponding to said stop member to force the wires riding on said stop to both sides thereof.

3. A protective casing, as claimed in claim 2, wherein said stop member comprises a triangular plate, and wherein said projection comprises a triangular cone.

4. A protective casing, as claimed in claim 3, wherein said projection is arranged on the inner surface of said lid so as not to interfere with said stop member when said casing body is closed by said lid.

5. A protective casing, as claimed in claim 1, wherein said lid has a wall on an end thereof in the longitudinal direction to close the opened side portion of said casing body.

6. A protective casing for accommodating an end connecting part of a bundle of wires, comprising:

a casing body forming a storage chamber therein to accommodate the end connecting part, said casing body having an opened upper portion and an opened side portion on at least one side thereof extending in the longitudinal direction; and a lid pivotably connected to said casing body to close said upper portion and said opened side portion;

wherein said casing body has, on a bottom wall thereof, an inwardly extending stop member inserted between the wires when the wires are accommodated in the protective casing, and wherein said lid has an inner surface with a projection disposed in a position directly opposed to said stop member to force the wires riding on said stop to both sides thereof.

7. A protective casing, as claimed in claim 6, wherein said inner surface of said lid is provided with a presser piece which presses against the end connecting part when said lid is closed against said casing body.

8. A protective casing, as claimed in claim 6, wherein said stop member comprises a triangular plate, and wherein said projection comprises a triangular cone.

9. A protective casing, as claimed in claim 8, wherein said projection is arranged on the inner surface of said lid so as not to interfere with said stop member when said casing body is closed by said lid.

10. A protective casing, as claimed in claim 6, wherein said lid has a wall extending in the longitudinal direction to close the opened side portion of said casing body.

11. A protective casing, as claimed in claim 10, wherein said wall extends uniformly and completely across an open end of the casing in the longitudinal direction to close the opened side portion of said casing body against individual wires in said bundle of wires.

12. A protective casing for accommodating an end connecting part of a bundle of wires, comprising:

a casing body forming a storage chamber therein to accommodate the end connecting part, said casing body having an opened upper portion and an opened side portion on at least one side thereof extending in the longitudinal direction; and a lid pivotably connected to said casing body to close said upper portion and said opened side portion, said lid having a longitudinal extending side wall to close the opened side portion of said casing body;

wherein said casing body has a bottom wall with an inwardly extending stop member inserted between the wires when the wires are accommodated in the protective casing;

wherein said lid has an inner surface with a presser piece which presses against the end connecting part when said lid is closed against said casing body.

13. A protective casing for accommodating an end connecting part of a bundle of wires, comprising:

a casing body forming a storage chamber therein to accommodate the end connecting part, said casing body having an opened upper portion and an opened side portion on at least one side thereof extending in the longitudinal direction; and a lid pivotably connected to said casing body to close said upper portion and said opened side portion, said lids having a longitudinal extending side wall to close the opened side portion of said casing body;

wherein said casing body has a bottom wall with an inwardly extending stop member inserted between the wires when the wires are accommodated in the protective casing;

wherein said lid has an inner surface with a projection disposed in a position directly corresponding to said stop member to force the wires riding on said stop to both sides thereof.

14. A protective casing, as claimed in claim 13, wherein said stop member comprises a triangular plate, and wherein said projection comprises a triangular cone.

15. A protective casing, as claimed in claim 14, wherein said projection is arranged on the inner surface of said lid so as not to interfere with said stop member when said casing body is closed by said lid.

* * * * *